US008967242B2

(12) United States Patent
Evans, II et al.

(10) Patent No.: US 8,967,242 B2
(45) Date of Patent: Mar. 3, 2015

(54) AUXILIARY FLOW LINE FILTER FOR SAMPLING PROBE

(75) Inventors: Wade Evans, II, Rosenberg, TX (US); Stephane Briquet, Kanagawa-ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 435 days.

(21) Appl. No.: 13/304,954

(22) Filed: Nov. 28, 2011

(65) Prior Publication Data

US 2012/0160514 A1 Jun. 28, 2012

Related U.S. Application Data

(60) Provisional application No. 61/426,613, filed on Dec. 23, 2010.

(51) Int. Cl.
*E21B 49/10* (2006.01)
*E21B 49/08* (2006.01)

(52) U.S. Cl.
CPC ..... *E21B 49/10* (2013.01)
USPC ..... 166/100; 166/264

(58) Field of Classification Search
CPC ..... E21B 49/10; E21B 49/08
USPC ..... 166/264, 100
See application file for complete search history.

(56) References Cited

U.S. PATENT DOCUMENTS 6,174,001 B1 1/2001 Enderle
7,204,309 B2 4/2007 Segura et al.
7,458,419 B2 12/2008 Nold, III et al.
7,584,786 B2 9/2009 Nold, III et al.
7,793,713 B2 9/2010 Nold, III et al.
2003/0098156 A1* 5/2003 Follini et al. ..... 166/264
2006/0076132 A1* 4/2006 Nold et al. ..... 166/264

OTHER PUBLICATIONS

Bunn, et al., "Design, Implementation, and Interpretation of a Three-Dimensional Well Test in the Cormorant Field, North Sea", SPE 15858—European Petroleum Conference, London, United Kingdom, Oct. 1986, 10 pages.
Bunn, et al., "Distributed Pressure Measurements Allow Early Quantification of Reservoir Dynamics in the Jene Field", SPE 17682—SPE Formation Evaluation vol. 6 (1), Mar. 1991, pp. 55-62.
Kaneda, et al., "Interpretation of a Pulse Test in a Layered Reservoir", SPE 21337—SPE Formation Evaluation, vol. 6 (4), Dec., 1991, pp. 453-462.
Lasseter, et al., "Interpreting an RFT-Measured Pulse Test with a Three-Dimensional Simulator", SPE 14878—SPE Formation Evaluation, vol. 3 (1), Mar., 1988, pp. 139-146.
Saeedi, et al., "Layer Pulse Testing Using a Wireline Formation Tester", SPE 16803—SPE Annual Technical Conference and Exhibition, Dallas, Texas, Sep. 1987, pp. 543-550.
Yaxley, et al., "A Field Example of Interference Testing Across a Partially Communicating Fault", SPE 19306, 1989, 41 pages.

* cited by examiner

*Primary Examiner* — Brad Harcourt
(74) *Attorney, Agent, or Firm* — Cathy Hewitt

(57) ABSTRACT

An apparatus includes a downhole tool for conveyance in a wellbore extending into a subterranean formation. The downhole tool includes a focused sampling probe that includes a piston movable between an open position and a closed position, an auxiliary filter coupled to the piston, and a scraper that interfaces with the auxiliary filter. Movement of the piston may cause the auxiliary filter to move against the scraper.

20 Claims, 9 Drawing Sheets

AUXILIARY FLOW LINE FILTER FOR SAMPLING PROBE

CROSS-REFERENCE TO RELATED APPLICATIONS

This application claims the benefit of U.S. Provisional Application No. 61/426,613, entitled "Auxiliary Flow Line Filter for Focused Sampling Probe," filed Dec. 23, 2010, the entire disclosure of which is hereby incorporated herein by reference.

BACKGROUND OF THE DISCLOSURE

Wellbores (also known as boreholes) are drilled to penetrate subterranean formations for hydrocarbon prospecting and production. During drilling operations, evaluations may be performed of the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation.

Formation evaluation may involve drawing fluid from the formation into a downhole tool for testing in situ and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
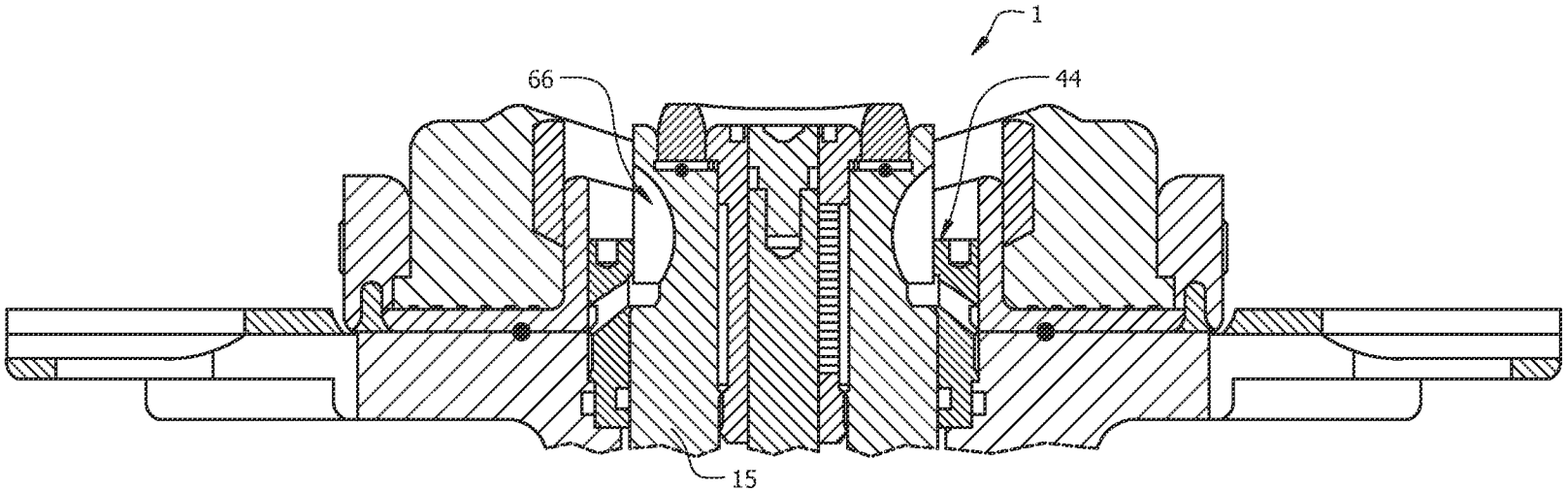
FIG. 1 is a sectional view of a probe block with a filter arrangement according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Conventional probe module designs filter auxiliary flow through two filters attached to a probe block. Auxiliary fluid flow coming from a geotechnical formation, for example, between the inner and outer packers proceeds into a conventional probe module via holes in the probe block. These holes lead to the two filters attached to the probe block. In such conventional designs, the holes are prone to plugging. Further, the filters are static, that is, no mechanism is provided to clean the filters downhole. Therefore, once plugged, these static filters can only be cleaned after the tool is brought out of the wellbore and back to the surface. Still further, in order to service the sequence valve in a conventional probe module, the probe block has to be dismounted from the probe module, as well as the cover (face seal) used to secure the filters in the probe block.

Figure 2:
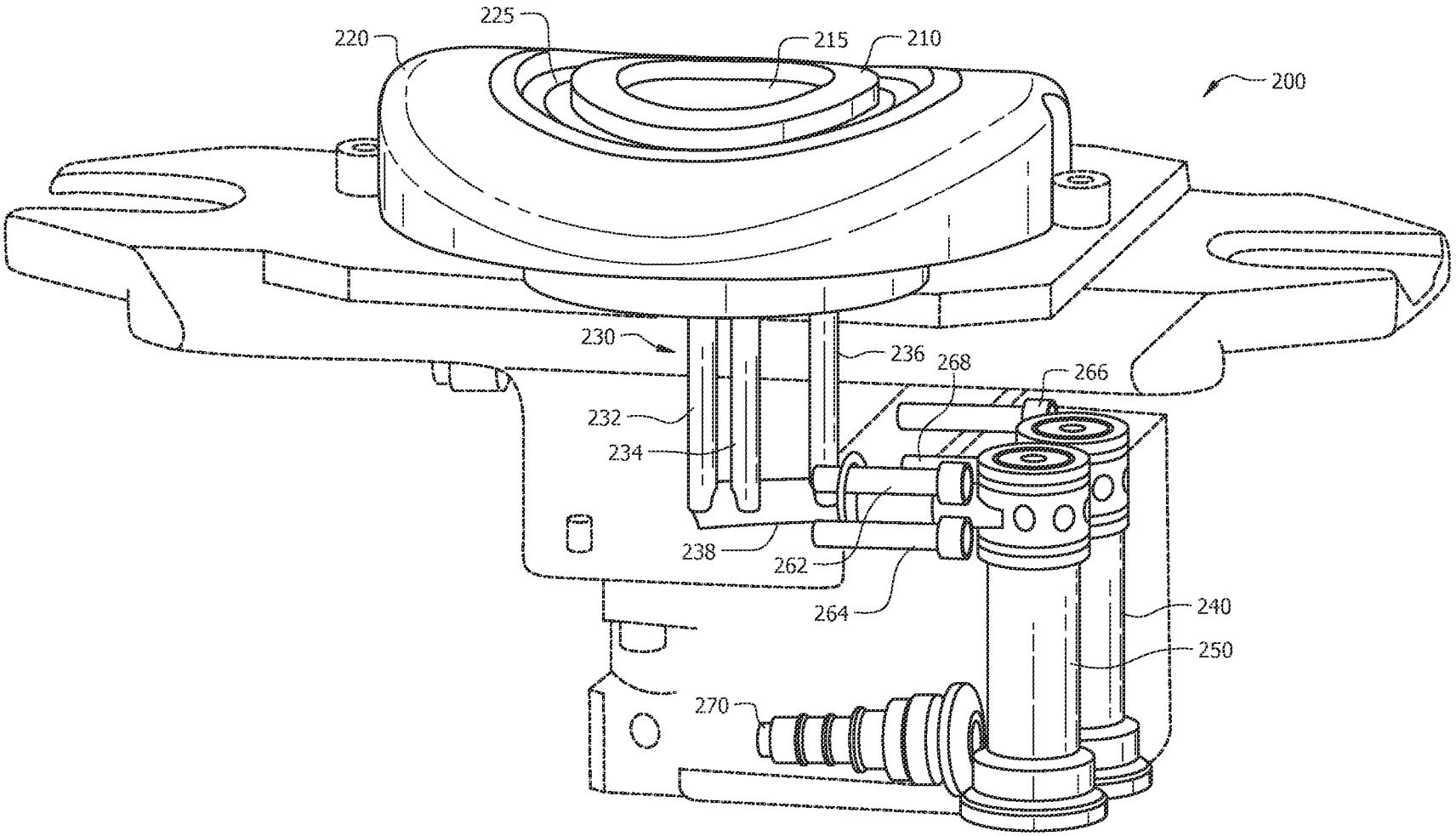
FIG. 2 is a schematic side view of a probe block in transparency according to one conventional design.

FIG. 2 is a schematic side view of a conventional probe block 200 in transparency. The probe block 200 has an inner sealing packer 210 and an outer sealing packer 220 defining a central inlet 215 and a peripheral inlet 225. The central inlet 215 and peripheral inlet 225 are coupled to two pumps (not shown) via a main flow line (not shown), and an auxiliary flow line 230, respectively. The auxiliary flow line 230 includes three holes 232, 234, 236 shown vertically that connect to a fourth hole 238 shown horizontally. The fourth hole 238 leads into two static filters 240, 250. In use, fluid may be drawn from the formation through the peripheral inlet 225 between the two sealing packers 210, 220 at the top, and may proceed down the three vertical holes 232, 234, 236 of the auxiliary flow line 230, through the horizontal hole 238 of the auxiliary flow line 230, and into the static filters 240, 250 attached in the probe block 200 of the downhole tool.

Still referring to FIG. 2, four bolts 262, 264, 266, 268 that are used to secure the face seal (not shown) are also provided to secure the filters 240, 250. A sequence valve 270 is also visible at the bottom of the probe block 200. Removing (servicing) the sequence valve 270 requires removal of the probe block 200 from the downhole tool, and then removal of the face seal (not shown) and the filters 240, 250.

Figure 3:
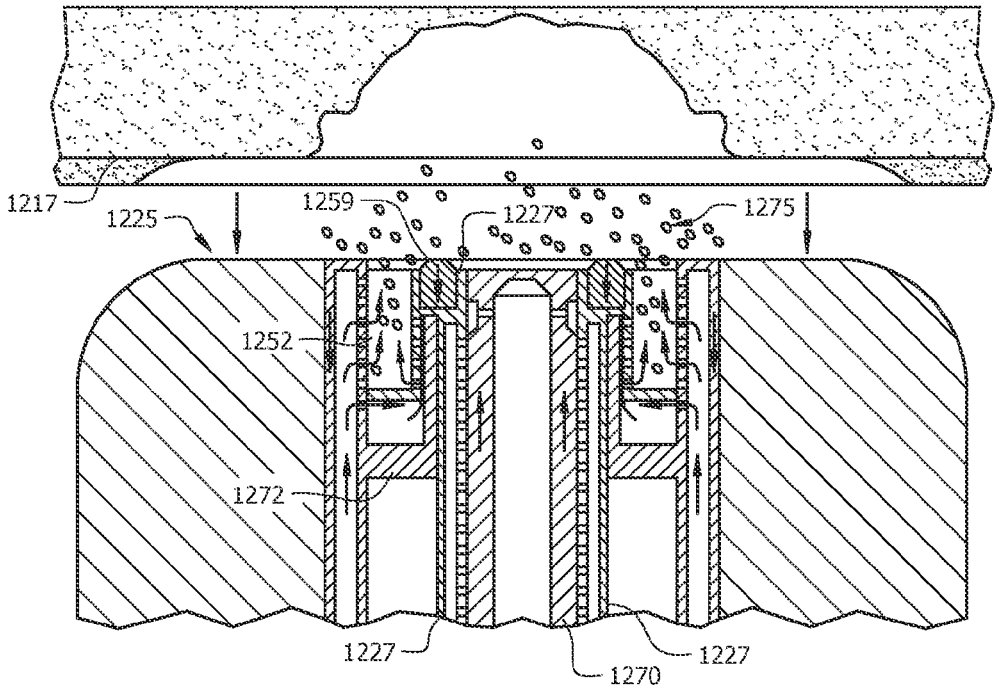
FIG. 3 is a sectional view of a portion of an auxiliary filter according to one conventional design.

FIG. 3 is a sectional view of a portion of a conventional auxiliary filter. As illustrated, a peripheral inlet is provided as element 1252. The filter of the peripheral inlet 1252 is exposed to the wellbore fluid when the probe is in a position used for conveyance. The filter may be plugged by debris present in the wellbore fluid. In order to clean out the debris in the conventional auxiliary filter, the flow through the tool must be reversed to dislodge the materials present on the filter. This clean out procedure prevents progression of tool use in the downhole environment, therefore impacting overall efficiency.

In accordance with aspects of the present disclosure, a wellsite with associated wellbore and apparatus is described in order to describe a typical, but not limiting, embodiment of the application. To that end, apparatus at the wellsite may be altered, as necessary, due to field considerations encountered.

Figure 11:
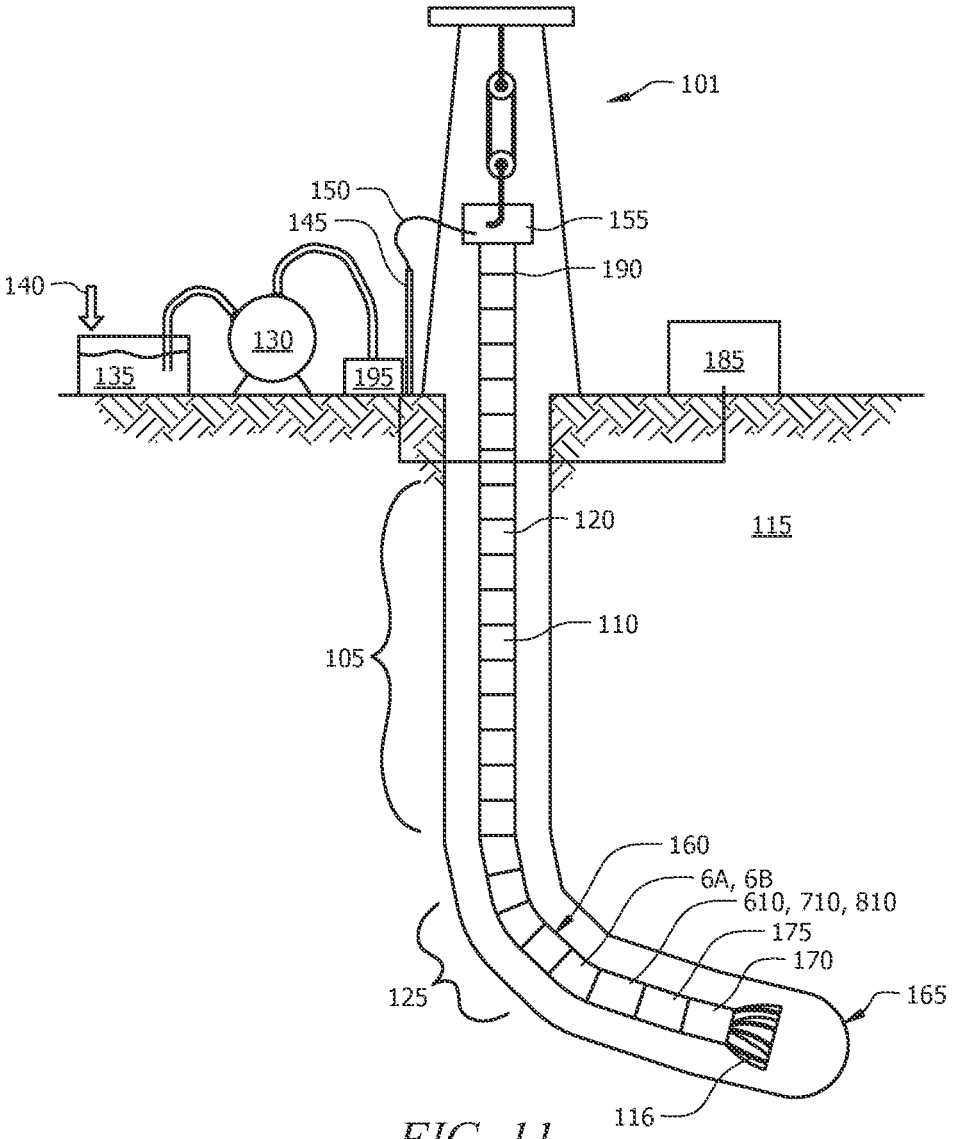
FIG. 11 is a schematic view, partially in cross-section, of a drill string extending from a drilling rig into a wellbore penetrating a subterranean formation, the drill string including a probe module according to one or more aspects of the present disclosure.

FIG. 11 illustrates a wellsite system in which aspects of the present disclosure may be implemented. The wellsite can be onshore or offshore. A drill string 105 may extend from a drill rig 101 into a well 110 penetrating a zone of the formation of reservoir 115. The drill string 105 may employ a mud pulse telemetry system for transmitting data from downhole to the surface. The drill string 105 may also employ another type of telemetry system or any combination of telemetry systems, such as electromagnetic, mud pulse, acoustic and\or wired drill pipe.

A bottom hole assembly is suspended at the end of the drill string 105. The bottom hole assembly may include one downhole tool, an assembly of downhole tools, or a string of downhole tools. In the illustrated example, the drill string 105 may include well logging tools 125 coupled to a lower end thereof. As used herein, the term well logging tool or a string of such tools, may include at least one or more measurement while drilling tools ("MWD"), logging while drilling tools ("LWD"), formation evaluation tools, formation sampling tools and other tools capable of measuring a characteristic of the subterranean formations of the reservoir 115 and\or of the well. In an embodiment, the bottom hole assembly comprises a plurality of MWD or LWD downhole tools 125, such as indicated by reference numerals 6A, 6B. For example, one or more of the downhole tools 6A, 6B may be a formation pressure while drilling tool.

Logging while drilling tools used at the end of the drill string 105 may include a thick walled housing, commonly referred to as a drill collar, and may include one or more of a number of logging devices. The logging while drilling tools may be capable of measuring, processing, and/or storing information therein, as well as communicating with equipment disposed at the surface of the well site.

Measurement while drilling tools may include one or more of the following measuring tools: a modulator, a weight on bit measuring device, a torque measuring device, a vibration measuring device, a shock measuring device, a stick slip measuring device, a direction measuring device, an inclination measuring device, and\or any other device.

Measurements made by the bottom hole assembly or other tools and sensors along the drill string 105 may be transmitted to a surface computing system 185 for analysis. For example, mud pulses may be used to broadcast formation measurements performed by one or more of the downhole tools 6A and 6B to the surface computing system 185.

The surface computing system 185 may host a plurality of models, such as a reservoir model, to acquire and process data from downhole components, as well as determine the bottom hole location in the reservoir 115 from measurement while drilling data.

A derrick or similar device may be used to move the drill string 105 within the well 110 that is being drilled through subterranean formations of the reservoir, generally at 115. The drill string 105 may be extended into the subterranean formations with a number of coupled drill pipes (one of which is designated 120) of the drill string 105. The drill pipe comprising the drill string 105 may be structurally similar to ordinary drill pipes, and may include a wire or cable associated with each drill pipe 120 that serves as a communication channel.

Several of the components disposed proximate to the drill rig 101 may be used to operate components of the system. The drill string 105 may be used to turn and actually urge a drill bit 116 into the bottom of the well 110 to increase its length (depth). During drilling of the well 110, a pump 130 lifts drilling fluid (mud) 135 from a tank 140 or pits and discharges the mud 135 under pressure through a standpipe 145 and flexible conduit 150 or hose, through a top drive 155 and into an interior passage inside the drill pipe 105. The mud 135 which can be water or oil-based, exits the drill pipe 105 through courses or nozzles (not shown separately) in the drill bit 116, wherein it cools and lubricates the drill bit 116 and lifts drill cuttings generated by the drill bit 116 to the surface of the earth through an annular arrangement.

When the well 110 has been drilled to a selected depth, the well logging tools 125 may be positioned at the lower end of the drill string 105 if not previously installed. The well logging tools 125 may be positioned by pumping the well logging tools 125 down the drill string 105 or otherwise moving the well logging tools 125 down the drill string 105 while the drill string 105 is within the well 110. The well logging tools 125 may then be coupled to an adapter sub 160 at the end of the drill string 105 and may be moved through, for example in the illustrated embodiment, a highly inclined portion 165 of the well 110, which would be inaccessible using armored electrical cable to move the well logging tools 125.

During well logging operations, the pump 130 may be operated to provide fluid flow to operate one or more turbines in the well logging tools 125 to provide power to operate certain devices in the well logging tools 125. However, when tripping in or out of the well 110, it may be infeasible to provide fluid flow. As a result, power may be provided to the well logging tools 125 in other ways. For example, batteries may be used to provide power to the well logging tools 125. In an embodiment, the batteries may be rechargeable batteries and may be recharged by turbines during fluid flow. The batteries may be positioned within the housing of one or more of the well logging tools 125. Other manners of powering the well logging tools 125 may be used including, but not limited to, one-time power used batteries.

As the well logging tools 125 are moved along the well 110 by moving the drill string 105, signals may be detected by various devices, of which non-limiting examples may include a resistivity measurement device, a bulk density measurement device, a porosity measurement device, a formation capture cross-section measurement device 170, a gamma ray measurement device 175 and a formation fluid sampling tool 610, 710, 810 which may include a formation pressure measurement device 6A and/or 6B. The signals may be transmitted toward the surface of the earth along the drill string 105.

An apparatus and system for communicating from the drill string 105 to the surface computer 185 or other component configured to receive, analyze, and/or transmit data may include a second adapter sub 190 that may be coupled between an end of the drill string 105 and the top drive 155 that may be used to provide a communication channel with a receiving unit 195 for signals received from the well logging tools 125. The receiving unit 195 may be coupled to the surface computer 185 to provide a data path therebetween that may be a bidirectional data path.

Though not shown, the drill string 105 may alternatively be connected to a rotary table, via a Kelly, and may suspend from a traveling block or hook, and additionally a rotary swivel. The rotary swivel may be suspended from the drilling rig 101 through the hook, and the Kelly may be connected to the rotary swivel such that the Kelly may rotate with respect to the rotary swivel. The Kelly may be any mast that has a set of polygonal connections or splines on the outer surface type that mate to a Kelly bushing such that actuation of the rotary table may rotate the Kelly.

An upper end of the drill string 105 may be connected to the Kelly, such as by threadingly reconnecting the drill string 105 to the Kelly, and the rotary table may rotate the Kelly, thereby rotating the drill string 105 connected thereto.

Although not shown, the drill string 105 may include one or more stabilizing collars. A stabilizing collar may be disposed within or connected to the drill string 105, in which the stabilizing collar may be used to engage and apply a force against the wall of the well 110. This may enable the stabilizing collar to prevent the drill string 105 from deviating from the desired direction for the well 110. For example, during drilling, the drill string 105 may "wobble" within the well 110, thereby allowing the drill string 105 to deviate from the desired direction of the well 110. This wobble action may also be detrimental to the drill string 105, components disposed therein, and the drill bit 116 connected thereto. A stabilizing collar may be used to minimize, if not overcome altogether, the wobble action of the drill string 105, thereby possibly increasing the efficiency of the drilling performed at the wellsite and/or increasing the overall life of the components at the wellsite.

One or more aspects of the present disclosure may provide a probe block comprising a dynamic filter that can be scraped clean while the probe block is downhole. The filter may be positioned at a fluid entry point in the probe block to decrease the chance of the flow line plugging. In another aspect, fluid may enter all around the filter, making the flow and/or the debris accumulation more uniform, which also reduces the risk of plugging.

One or more aspects of the present disclosure may provide a probe block with fewer parts than conventional apparatus, thereby making the probe block easier to assemble. In one aspect, the auxiliary filter is "added" to the original set piston. The probe block may comprise fewer o-rings and fewer face seals than conventional apparatus.

One or more aspects of the present disclosure may provide a sequence valve installed from the bottom of the probe block such that the sequence valve and the filter can be removed while the probe block is installed in the probe module, thereby making the probe block easier to maintain than conventional apparatus.

FIG. 1 is a sectional view of a probe block 1 with an auxiliary filter 66 according to one or more aspects of the present disclosure. The auxiliary filter 66 is provided on a set piston 15 in a probe assembly to be used downhole as provided in FIG. 11. As the set piston 15 is pressed up against the borehole wall, for example, the auxiliary filter 66 is "opened" and the fluid can start being pulled in through the auxiliary filter 66 so that the fluid may be effectively filtered. As the set piston 15 is being retracted, an auxiliary scraper 44 cleans the face of the auxiliary filter 66. Thus, the position of the set position 15 allows for the auxiliary scraper 44 to be used or stored as needed.

Figure 4:
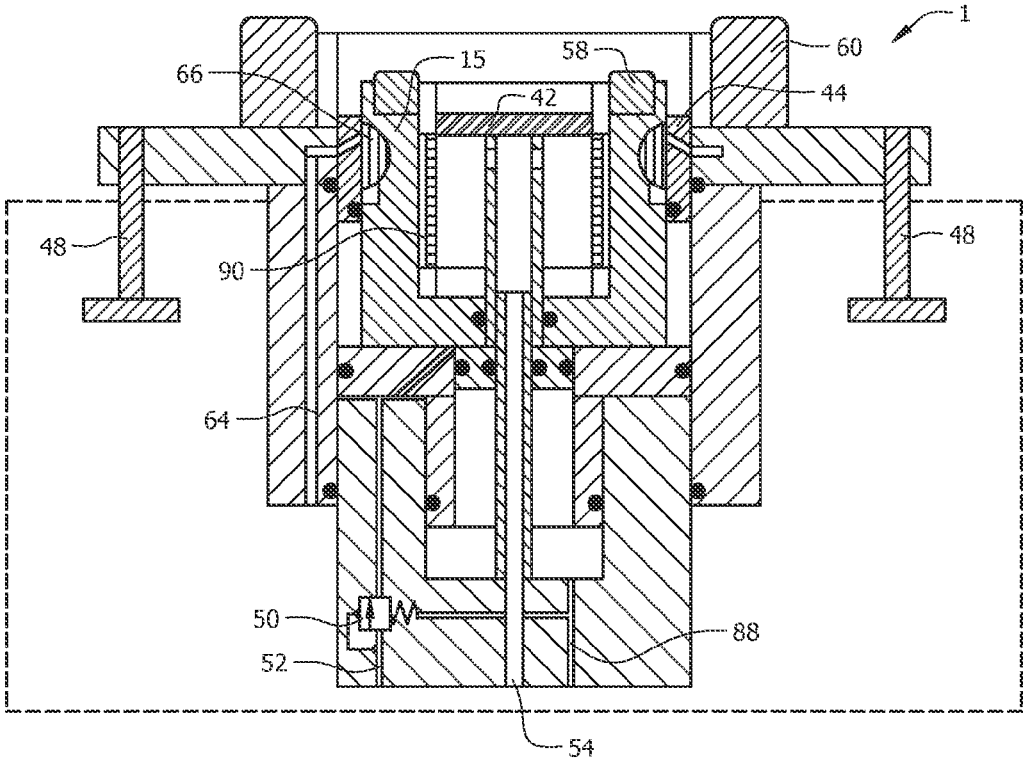
FIG. 4 is a schematic sectional view of a probe block according to one or more aspects of the present disclosure, the probe block depicted in a retracted or closed position.
Figure 5:
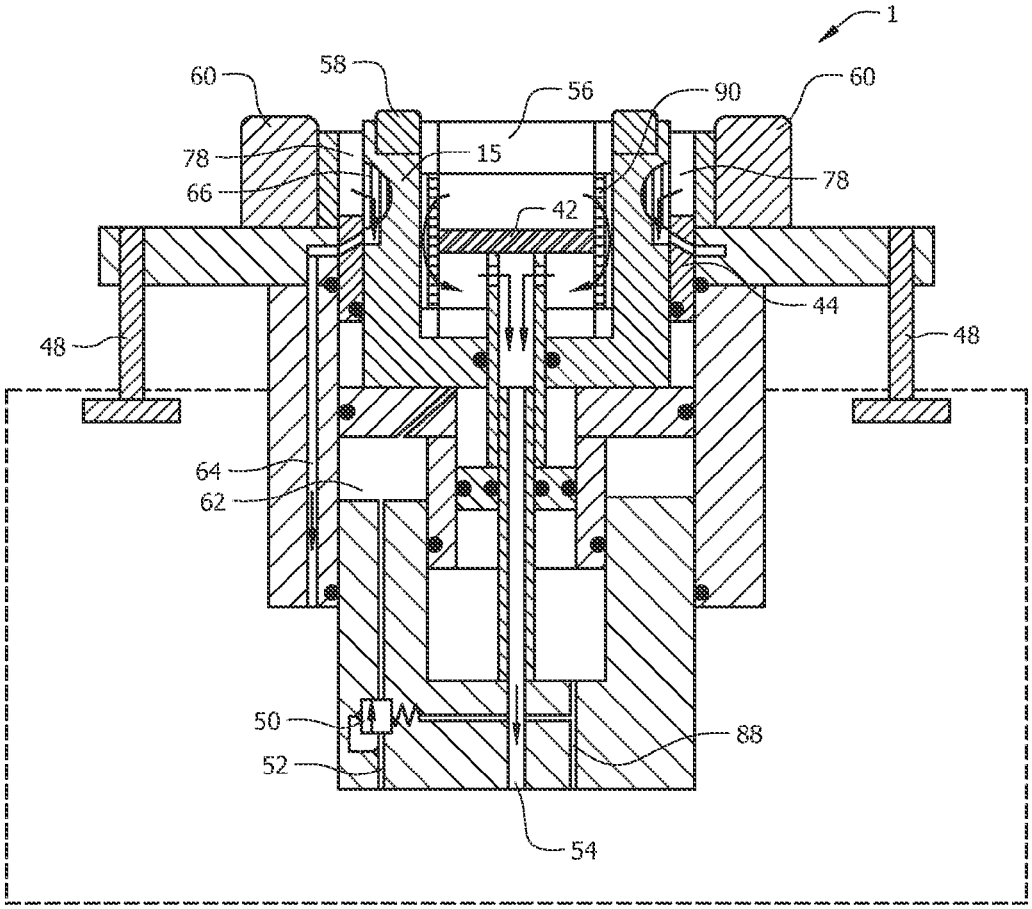
FIG. 5 is a schematic sectional view of the probe block of FIG. 4 in an extended or opened position.

FIG. 4 is a schematic sectional view of the probe block 1 according to one or more aspects of the present disclosure, the probe block 1 depicted in a retracted or closed position. A filter piston 42 allows for actuation of a scraper 44. When the probe block 1 is positioned next to a subterranean formation, for example, probe extension pistons 48 extend, thereby allowing for scraper 44 actuation. A sequence valve 50 is positioned with a hydraulic set line 52 to allow for hydraulic actuation of a fluid chamber, as illustrated in FIG. 5, for opening of the entire probe block 1. A hydraulic retract line 88 is also positioned to withdraw fluid from the sequence valve 50 to allow for refraction of the set piston 15. A primary filter 90 is positioned on the inside surface of the filter piston 42.

FIG. 5 is a schematic sectional view of the probe block 1 of FIG. 4 in an extended or opened position. The main flow line 54 is configured to accept fluid flow from the subterranean formation. A central inlet 56 is positioned with inner packers 58 on the periphery. Fluid may flow through the main flow line 54 for further use within the tool. Outer packers 60 are also positioned to abut the subterranean formation to provide additional assurance of seal integrity. In the open position, the chamber 62 is expanded, thus allowing fluid to not only enter through the main flow line 54, but also through the auxiliary flow line 64. During motion of the filter piston 42, a scraper 44 contacts the outer face of the auxiliary filter 66 positioned on the periphery. The scraper 44 may be made of metal or plastic for wear. In the illustrated embodiment, the scraper 44 is made of metal for capabilities to withstand elevated downhole temperatures. For stability of the entire design, probe extension pistons 48 extend and abut a tool, allowing the outer packers 60 and inner packers 58 to abut the subterranean formation and withdraw fluid.

In the open configuration depicted in FIG. 5, fluid flows from the formation though the auxiliary filter 66 through the central inlet 56. The filter 66 correspondingly filters the incoming fluid that passes down through the auxiliary flow line 64. A set of peripheral inlets 78 allows fluid from the subterranean formation to flow in through the auxiliary filter 66.

Figure 6:
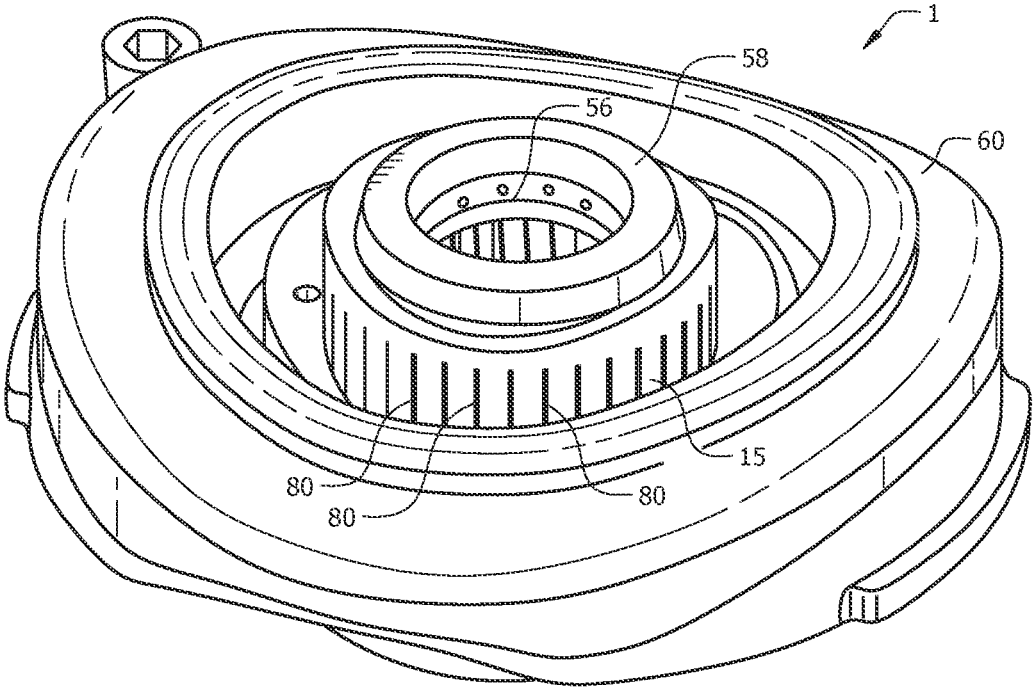
FIG. 6 is a schematic perspective view, partially in transparency, of a portion of a probe block according to one or more aspects of the present disclosure.

FIG. 6 is a schematic perspective view, partially in transparency, of a portion of the probe block 1 according to one or more aspects of the present disclosure. In one aspect, vertical machined slots 80 may be placed into the set piston 15 for large scale filtering purposes.

Figure 7:
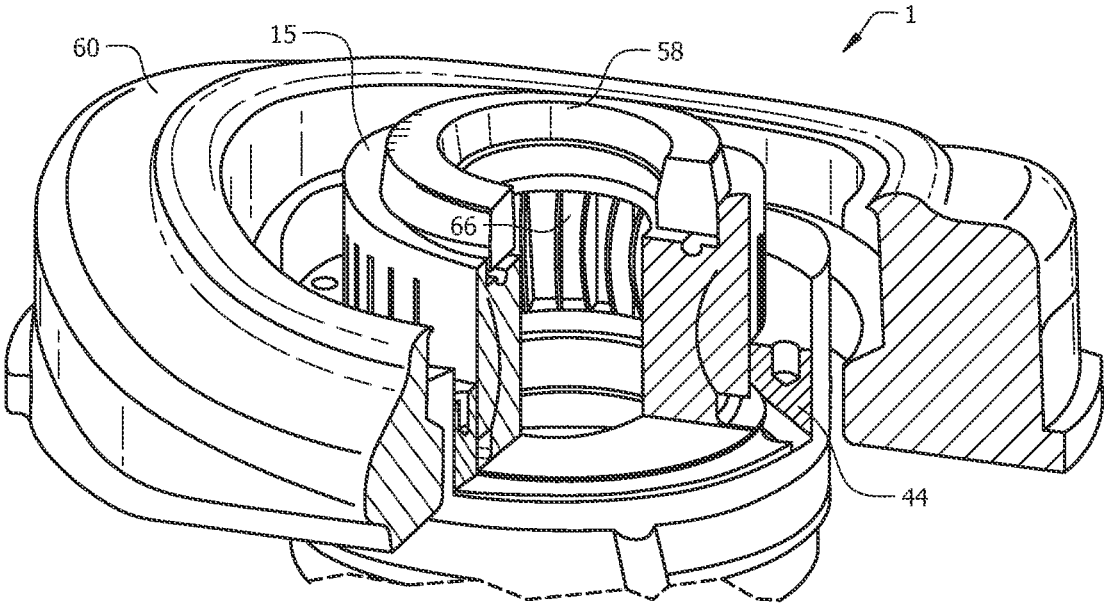
FIG. 7 is a schematic perspective view, partially in transparency and partially in cross section, of the portion of the probe block shown in FIG. 6.

FIG. 7 is a schematic perspective view, partially in transparency and partially in cross section, of a portion of the probe block 1 according to one or more aspects of the present disclosure. In this cross-sectional view, the interior of the filter 66 and the scraper 44 are provided. The formation fluid from the subterranean formation can enter the probe block 1 all around the auxiliary filter 66. The fluid is then collected in a circumferential groove machined in the filter piston 42 that is in fluid communication with the filter slots 80. The fluid can then proceed through holes 70 drilled across the scraper 44.

Figure 8:
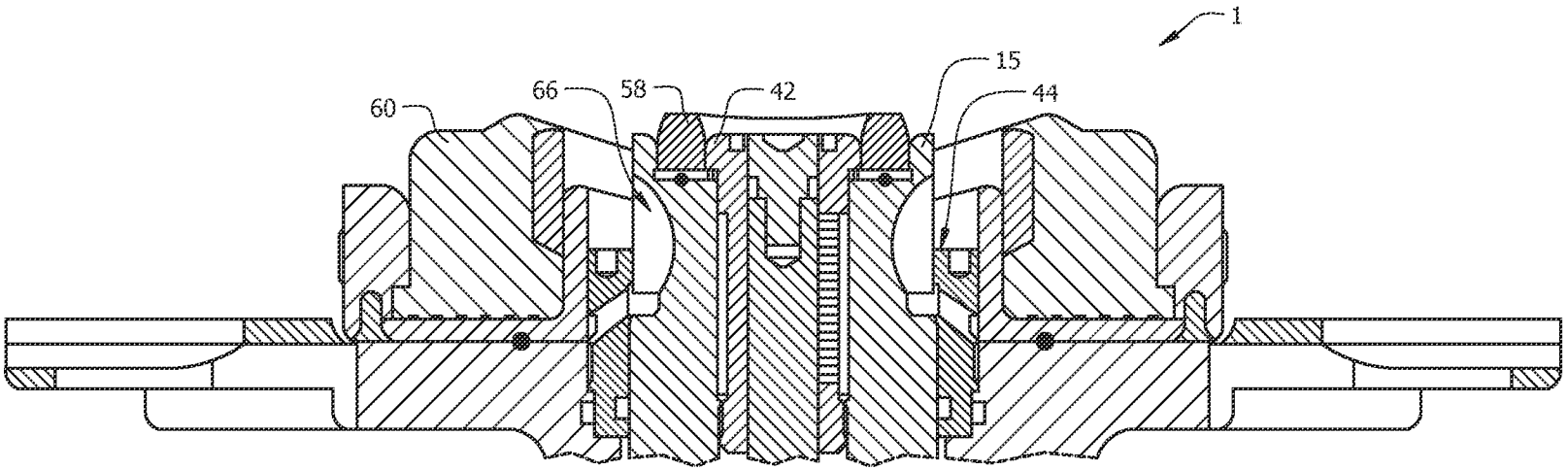
FIG. 8 is a sectional view of a portion of a probe block according to one or more aspects of the present invention, depicting a filter piston before it is retracted into the probe block.
Figure 9:
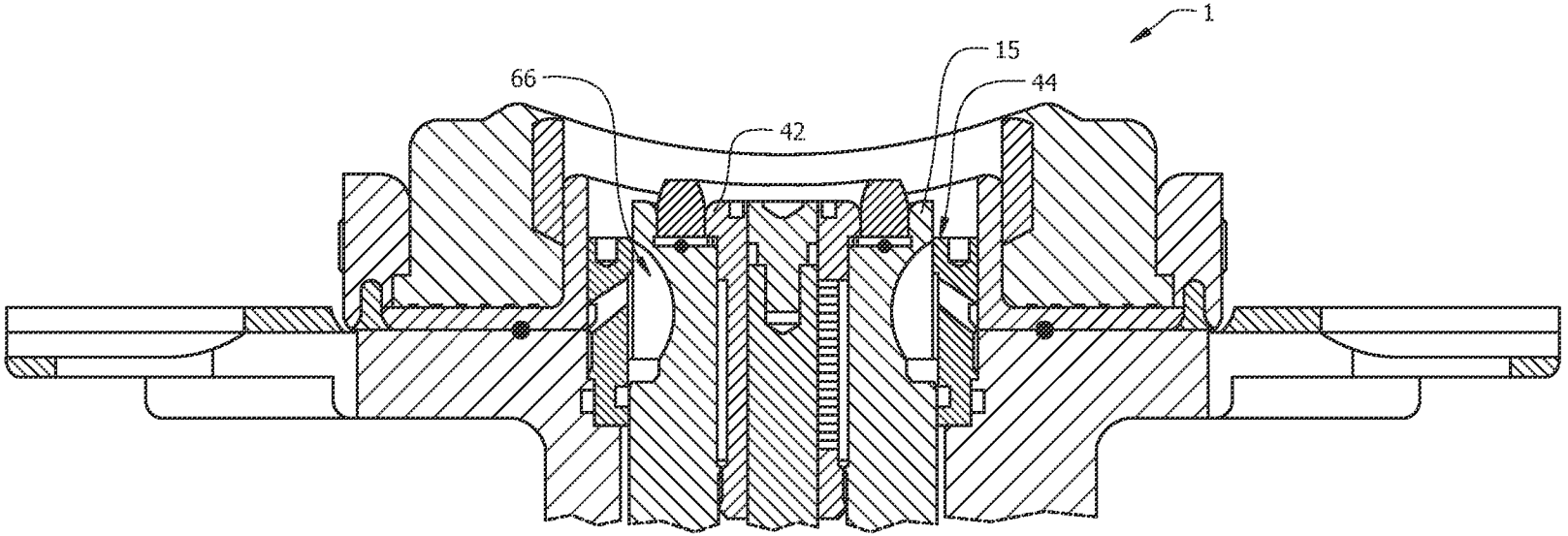
FIG. 9 is a sectional view of the portion of the probe block shown in FIG. 8, depicting the filter piston retracted into the probe block.

FIGS. 8 and 9 provide cross-sectional views of the probe block 1 wherein the auxiliary filter 66 is scraped clean when the filter piston 42 is retracted into the probe block 1. FIG. 8 depicts the filter piston 42 before it is retracted into the probe block 1, and FIG. 9 depicts the filter piston 42 partially retracted into the probe block 1. As the filter piston 42 retracts, the auxiliary filter 66 engages and moves past the scraper 44, which remains stationary and scrapes the auxiliary filter 66 clean.

Figure 10:
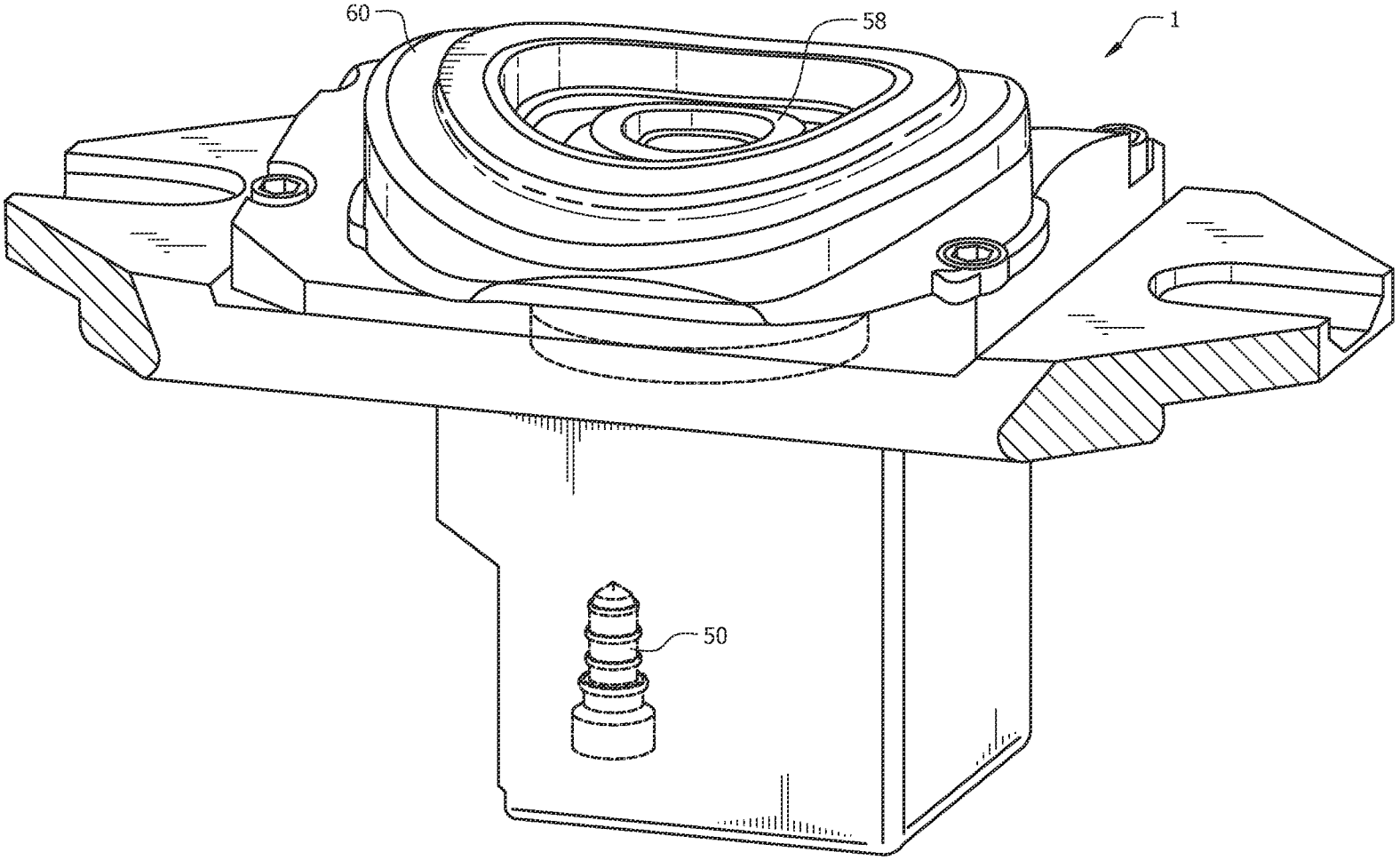
FIG. 10 is a perspective view, partially in transparency, of a portion of a probe block with a sequence valve disposed at the bottom according to one or more aspects of the present disclosure.

FIG. 10 is a perspective view, partially in transparency, of a portion of the probe block 1 with the sequence valve 50 therein according to one or more aspects of the present disclosure. The sequence valve 50 is provided such that it may be installed from the bottom of the probe block 1.

In accordance with one aspect of the disclosure, an apparatus including a downhole tool for conveyance in a wellbore extending into a subterranean formation is disclosed. The downhole tool includes a focused sampling probe that includes a piston movable between an open position and a closed position, an auxiliary filter coupled to the piston, and a scraper that interfaces with the auxiliary filter. Movement of the piston may cause the auxiliary filter to move against the scraper. The focused sampling probe may further include a sequence valve in fluid communication with the piston. Fluid flow through the sequence valve may move the piston from the closed position to the open position. The focused sampling probe may further include a hydraulic retract line coupled to the sequence valve. The hydraulic retract line may withdraw fluid through the sequence valve to move the piston from the open position to the closed position.

In accordance with another aspect of the disclosure, an apparatus including a downhole tool for conveyance in a wellbore extending into a subterranean formation is disclosed. The downhole tool includes a focused sampling probe that includes an auxiliary filter and a scraper that slidingly engages the auxiliary filter. Relative movement between the auxiliary filter and the scraper may clean an outer face of the auxiliary filter. The focused sampling probe may further include a piston coupled to the auxiliary filter. The piston may be moveable between an open position and a closed position. The focused sampling probe may further include a sequence valve in fluid communication with the piston. Fluid flow through the sequence valve in a first direction may move the piston from the closed position to the open position, and fluid flow through the sequence valve in a second direction may move the piston from the open position to the closed position.

In accordance with another aspect of the disclosure, a method is disclosed that includes positioning a tool near a subterranean formation, actuating a piston from a first closed position to a second open position, during the actuation of the piston, scraping an exterior face of a filter, and accepting a flow of fluid from the subterranean formation through the filter. The method may further include accepting a flow of fluid from the subterranean formation through an auxiliary flow line.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool for conveyance in a wellbore extending into a subterranean formation, wherein the downhole tool comprises a focused sampling probe that comprises:
- an outer packer;
- a set piston;
- an inner packer carried with the set piston and comprising a central fluid inlet, wherein an annulus defined between the inner and outer packers comprises a peripheral fluid inlet;

a main flow line;

a primary filter carried with the set piston;

a filter piston slidable relative to the set piston between:
- a first position, in which the filter piston prevents fluid, received from the formation in the central fluid inlet, from flowing through the primary filter to the main flow line; and
- a second position, in which the filter piston permits fluid, received from the formation in the central fluid inlet, to flow through the primary filter to the main flow line;

an auxiliary flow line;

a scraper positionally fixed relative to the outer packer; and an auxiliary filter carried externally with the set piston and in selective fluid communication between the peripheral fluid inlet and the auxiliary flow line based on an axial position of the set piston relative to the scraper, wherein the scraper scrapes against the auxiliary filter in response to axial movement of the set piston relative to the scraper.

2. The apparatus of claim 1 wherein the outer packer is extendable from the downhole tool.

3. The apparatus of claim 1 wherein the outer packer is extendable from the downhole tool via operation of a plurality of probe extension pistons.

4. The apparatus of claim 1 wherein the set piston is operable to translate relative to the outer packer in response to hydraulic pressure applied to the set piston by the downhole tool.

5. The apparatus of claim 1 wherein the filter piston scrapes against the primary filter in response to axial movement between the first and second positions.

6. The apparatus of claim 1 wherein the peripheral fluid inlet is annulus-shaped.

7. The apparatus of claim 1 wherein debris blocked by the primary filter while carried by fluid flowing from the central fluid inlet to the main flow line through the primary filter is scraped away from the primary filter by the filter piston during movement of the filter piston from the second position towards the first position.

8. The apparatus of claim 1 wherein debris blocked by the auxiliary filter while carried by fluid flowing from the peripheral fluid inlet to the auxiliary flow line through the auxiliary filter is scraped away from the auxiliary filter by the scraper during movement of the set piston inward relative to the outer packer.

9. The apparatus of claim 1 wherein:

first debris blocked by the primary filter while carried by fluid flowing from the central fluid inlet to the main flow line through the primary filter is scraped away from the primary filter by the filter piston during movement of the filter piston from the second position towards the first position; and second debris blocked by the auxiliary filter while carried by fluid flowing from the peripheral fluid inlet to the auxiliary flow line through the auxiliary filter is scraped away from the auxiliary filter by the scraper during movement of the set piston inward relative to the outer packer.

10. An apparatus, comprising:

a downhole tool for conveyance in a wellbore extending into a subterranean formation, wherein the downhole tool comprises a focused sampling probe that comprises:

an outer packer;

a set piston;

an inner packer carried with the set piston and comprising a central fluid inlet, wherein an annulus defined between the inner and outer packers comprises a peripheral fluid inlet;

a main flow line;

a primary filter carried with the set piston;

a filter piston;

an auxiliary flow line;

a scraper positionally fixed relative to the outer packer; and an auxiliary filter carried externally with the set piston;

wherein the focused sampling probe is configurable between:

a first configuration in which:

the filter piston blocks fluid, received in the central fluid inlet from the formation, from flowing through the primary filter to the main flow line; and the scraper blocks fluid, received in the peripheral fluid inlet from the formation, from flowing through the auxiliary filter to the auxiliary flow line; and a second configuration in which:

the filter piston permits fluid, received in the central fluid inlet from the formation, to flow through the primary filter to the main flow line; and the scraper permits fluid, received in the peripheral fluid inlet from the formation, to flow through the auxiliary filter to the auxiliary flow line.

11. The apparatus of claim 10 wherein the outer packer is extendable from the downhole tool.

12. The apparatus of claim 10 wherein the outer packer is extendable from the downhole tool via operation of a plurality of probe extension pistons.

13. The apparatus of claim 10 wherein the focused sampling probe is configurable between the first and second configurations via hydraulic pressure changes applied by the downhole tool.

14. The apparatus of claim 10 wherein the filter piston scrapes against the primary filter in response to transition of the focused sampling probe between the first and second configurations.

15. The apparatus of claim 10 wherein the peripheral fluid inlet is annulus-shaped.

16. The apparatus of claim 10 wherein debris blocked by the primary filter while carried by fluid flowing from the central fluid inlet to the main flow line through the primary filter is scraped away from the primary filter by the filter piston during transition of the focused sampling probe from the second configuration towards the first configuration.

17. The apparatus of claim 10 wherein debris blocked by the auxiliary filter while carried by fluid flowing from the peripheral fluid inlet to the auxiliary flow line through the auxiliary filter is scraped away from the auxiliary filter by the scraper during transition of the focused sampling probe from the second configuration towards the first configuration.

18. A method, comprising:

conveying a downhole tool within a wellbore to a subterranean formation, wherein the downhole tool comprises a focused sampling probe that comprises:

an outer packer;

a set piston;

an inner packer carried with the set piston and comprising a central fluid inlet, wherein an annulus defined between the inner and outer packers comprises a peripheral fluid inlet;

a main flow line;

a primary filter carried with the set piston;

a filter piston;

an auxiliary flow line;

a scraper positionally fixed relative to the outer packer; and an auxiliary filter carried externally with the set piston;

wherein the focused sampling probe in a first configuration in which:

the filter piston blocks fluid, received in the central fluid inlet from the formation, from flowing through the primary filter to the main flow line; and the scraper blocks fluid, received in the peripheral fluid inlet from the formation, from flowing through the auxiliary filter to the auxiliary flow line; then transitioning the focused sampling probe from the first configuration to a second configuration in which:

the filter piston permits fluid, received in the central fluid inlet from the formation, to flow through the primary filter to the main flow line; and the scraper permits fluid, received in the peripheral fluid inlet from the formation, to flow through the auxiliary filter to the auxiliary flow line.

19. The method of claim 18 further comprising:

extending the outer packer from the downhole tool into contact with a wall of the wellbore after conveying the downhole tool within the wellbore to the subterranean formation and before transitioning the focused sampling probe into the second configuration;

pumping fluid from the subterranean formation into the downhole tool while the focused sampling probe is in the second configuration, including:

pumping a first fluid stream from the subterranean formation through the central fluid inlet, through the primary filter, and into the main flow line; and pumping a second fluid stream from the subterranean formation through the peripheral fluid inlet, through the auxiliary filter, and into the auxiliary flow line;

ceasing pumping fluid from the subterranean formation into the downhole tool, and then transitioning the focused sampling probe from the second configuration to the first configuration;

after transitioning the focused sampling probe to the first configuration, retracting the outer packer from the wall of the wellbore, and then conveying the downhole tool to a new location within the wellbore.

20. The method of claim 19 wherein:

debris blocked by the primary filter while carried by fluid flowing from the central fluid inlet to the main flow line through the primary filter is scraped away from the primary filter by the filter piston during transition of the focused sampling probe from the second configuration towards the first configuration; and debris blocked by the auxiliary filter while carried by fluid flowing from the peripheral fluid inlet to the auxiliary flow line through the auxiliary filter is scraped away from the auxiliary filter by the scraper during transition of the focused sampling probe from the second configuration towards the first configuration.

* * * * *